US010825472B2

(12) United States Patent
Falk et al.

(10) Patent No.: US 10,825,472 B2
(45) Date of Patent: Nov. 3, 2020

(54) METHOD AND APPARATUS FOR VOICED SPEECH DETECTION

(71) Applicant: TELEFONAKTIEBOLAGET LM ERICSSON (PUBL), Stockholm (SE)

(72) Inventors: Tommy Falk, Spånga (SE); Harald Pobloth, Täby (SE); Erlendur Karlsson, Uppsala (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 51 days.

(21) Appl. No.: 15/976,444

(22) Filed: May 10, 2018

(65) Prior Publication Data

US 2018/0261239 A1 Sep. 13, 2018

Related U.S. Application Data

(63) Continuation of application No. PCT/EP2015/077082, filed on Nov. 19, 2015.

(51) Int. Cl.

| | |
|---|---|
| ***G10L 25/84*** | (2013.01) |
| ***G10L 25/90*** | (2013.01) |
| ***G10L 25/21*** | (2013.01) |
| ***G10L 25/93*** | (2013.01) |

(52) U.S. Cl.

CPC ..... *G10L 25/84* (2013.01); *G10L 25/21* (2013.01); *G10L 25/90* (2013.01); *G10L 25/93* (2013.01)

(58) Field of Classification Search

CPC ..... G10L 25/84; G10L 25/21; G10L 25/90

See application file for complete search history.

(56) References Cited

U.S. PATENT DOCUMENTS

| | | | | |
|---|---|---|---|---|
| 5,152,007 | A * | 9/1992 | Uribe | H03G 3/342 455/116 |
| 5,959,155 | A * | 9/1999 | Ohmae | C07C 407/003 568/568 |
| 6,167,372 | A * | 12/2000 | Maeda | G10L 19/18 704/207 |
| 6,691,092 | B1 * | 2/2004 | Udaya Bhaskar | G10L 19/097 704/205 |
| 8,666,734 | B2 | 3/2014 | Espy-Wilson et al. | |
| 2005/0055204 | A1 | 3/2005 | Florencio et al. | |

(Continued)

FOREIGN PATENT DOCUMENTS

| | | |
|---|---|---|
| EP | 1143414 A1 | 10/2001 |
| EP | 1335350 A2 | 8/2003 |

OTHER PUBLICATIONS

International Search Report and Written Opinion issued by the International Searching Authority in corresponding application No. PCT/EP2015/077082, dated Jan. 27, 2016, 10 pages.

(Continued)

*Primary Examiner* — Fariba Sirjani

(74) *Attorney, Agent, or Firm* — Rothwell, Figg, Ernst & Manbeck, P.C.

(57) ABSTRACT

Detecting voiced speech in an audio signal. A method comprises calculating an autocorrelation function (ACF) of a portion of an input audio signal and detecting a highest peak of said autocorrelation function within a determined range. A peak width and a peak height of said detected highest peak are determined and based on the peak width and the peak height it is decided whether a segment of an input audio signal comprises voiced speech.

20 Claims, 11 Drawing Sheets

(56) References Cited

U.S. PATENT DOCUMENTS

| | | | | |
|---|---|---|---|---|
| 2005/0149321 | A1 | 7/2005 | Kabi et al. | |
| 2009/0076814 | A1 | 3/2009 | Lee | |
| 2010/0017201 | A1* | 1/2010 | Tanaka | G10L 19/018 704/207 |
| 2014/0177853 | A1* | 6/2014 | Toyama | G10L 21/0208 381/58 |
| 2014/0372131 | A1* | 12/2014 | Disch | G10L 19/02 704/500 |
| 2015/0058002 | A1 | 2/2015 | Yermeche et al. | |
| 2015/0213812 | A1* | 7/2015 | Sasaki | G10L 25/90 704/211 |
| 2015/0281433 | A1* | 10/2015 | Gainsboro | H04M 3/42221 379/88.01 |
| 2015/0348536 | A1* | 12/2015 | Ando | G10L 15/02 704/234 |

OTHER PUBLICATIONS

Kumar et al., "A New Pitch Detection Scheme Based on ACF and AMDF," 2014 IEEE International Conference on Advanced Communication Control and Computing Technologies (ICACCT), ISBN No. 978-1-4799-3914-5114, pp. 1235-1240.

Atkinson et al., "Pitch detection of speech signals using segmented autocorrelation," Electronics Letters, vol. 31. No. 7, Mar. 1995, pp. 533-535.

Ghaemmaghami et al., "Noise Robust Voice Activity Detection Using Features Extracted From the Time-Domain Autocorrelation Function," Speech and Audio Research Laboratory, Queensland University of Technology, http://eprints.qut.edu.au/40656, 2010, 5 pages.

Portion of the File History for U.S. Appl. No. 15/021,441 (Aug. 2016 to Jan. 2017), 5 pages.

* cited by examiner

METHOD AND APPARATUS FOR VOICED SPEECH DETECTION

CROSS-REFERENCE TO RELATED APPLICATIONS

This application is a continuation of International patent application no. PCT/EP2015/077082, filed on Nov. 19, 2015 (published as WO 2016046421), which designates the United States. The above identified application and publication are incorporated by this reference.

TECHNICAL FIELD

The present application relates to a method and devices for detecting voiced speech in an audio signal.

BACKGROUND

Voice Activity Detection (VAD) is used in speech processing to detect the presence or absence of human speech in a signal. In speech processing applications, voice activity detection plays an important role since non-speech frames may often be discarded. Within speech codecs voice activity detection is used to decide when there is actually speech that should be coded and transmitted, thus avoiding unnecessary coding and transmission of silence or background noise frames. This is known as Discontinuous Transmission (DTX). As another example, voice activity detection may be used as a pre-processing step to other audio processing algorithms to avoid running more complex algorithm on data that does not contain speech, e.g., in speech recognition. Voice activity detection may also be used as part of an automatic level control/automatic gain control (ALC/AGC), where the algorithm needs to know when there is active speech and the active speech level can be measured. In a videoconference mixer, voice activity detection may be used as a trigger for deciding which conference participant is currently the active one and should be shown in the main video window.

Voice activity detection is often based on a combination of techniques to detect different sounds that make up spoken language. Speech contains sounds that are tonal, called voiced, and sounds that are non-tonal, called unvoiced. These sounds are very different both in character and the way they are physically produced. Therefore, different approaches to detect these two are usually used in VAD.

In order to detect voiced speech, different types of pitch detection techniques are typically used. There are numerous methods to perform pitch detection and many of them are based on an Auto-Correlation Function (ACF):

$$ACF_{ss}(t,l)=\Sigma_{n=0}^{N-1}s(t+n)\bar{s}(t+n-l),$$

where s is the input signal, l is the number of samples of delay, called lag, and (t:t+N−1) is the analysis window at time t of length N, over which the autocorrelation sum is evaluated.

The ACF gives information of cyclic behavior of the investigated signal where a strong pitch generates a series of peaks. Typically the highest peak is the one corresponding to the fundamental frequency of the pitched sound. FIG. 1 illustrates a typical example of an ACF for a voiced speech signal. In this case the position of the highest peak in the ACF corresponds to the fundamental period. The x-axis shows the bin number. With 48 kHz sampling frequency each bin corresponds to 0.02 ms.

There are however cases where the ACF has peaks that do not correspond to a pitched sound. Existing methods are either not robust enough and will false trigger on sounds that are not pitched, or they are complicated and complex to implement.

SUMMARY

An object of the present teachings is to solve or at least alleviate at least one of the above mentioned problems by enabling robust detection of voiced speech.

Various aspects of examples of the invention are set out in the claims.

According to a first aspect, a method is provided for detecting voiced speech in an audio signal. The method comprises calculating an autocorrelation function, ACF, of a portion of an input audio signal and detecting a highest peak of said autocorrelation function within a determined range. A peak width and a peak height of said peak are determined and based on the peak width and the peak height it is decided whether a segment of an input audio signal comprises voiced speech.

According to a second aspect, an apparatus is provided, wherein the apparatus comprises a processor and a memory storing instructions that, when executed by the processor, cause the apparatus to: calculate an autocorrelation function, ACF, of a portion of an input audio signal; detect a highest peak of said autocorrelation function within a determined range; determine a peak width and a peak height of said peak; and decide based on the peak width and the peak height whether a segment of an input audio signal comprises voiced speech.

According to a third aspect a computer program is provided comprising computer readable code units which when run on an apparatus causes the apparatus to: calculate an autocorrelation function, ACF, of a portion of an input audio signal; detect a highest peak of said autocorrelation function within a determined range; determine a peak width and a peak height of said peak; and decide based on the peak width and the peak height whether a segment of an input audio signal comprises voiced speech.

According to a fourth aspect, a computer program product comprises a computer readable medium storing a computer program according to the above-described third aspect.

According to a fifth aspect, a detector for detecting voiced speech in an audio signal is provided. The detector comprises an ACF calculation module configured to calculate an ACF of a portion of an input audio signal, a peak detection module configured to detect a highest peak of the ACF within a determined range, and a peak height and width determination module configured to determine a peak width and a peak height of the detected highest peak. The detector further comprises a decision module configured to decide based on the peak width and the peak height whether a segment of an input audio signal comprises voiced speech.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION

An example embodiment of the present invention and its potential advantages are understood by referring to FIGS. 1 through 11 of the drawings.

In a method that specifically should detect speech, knowledge about the way that speech sounds are physically produced can be exploited. Speech is composed of phonemes, which are produced by vocal cords and a vocal tract (which includes the mouth and the lips). In voiced speech, the sound source is vibrating vocal folds that produce a pulse train signal that is then filtered by acoustic resonances of the vocal tract. Even after the filtering process of the vocal tract the sound signal can be characterized as a series of pulses with some added decay from the acoustic resonance of the vocal tract. This characteristic is also reflected in the ACF of the signal as relatively narrow and sharp peaks, and can be used to distinguish voiced speech from other sounds.

As an example, certain sounds like keyboard typing, hand clapping etc. with a strong attack can generate peaks in the ACF that look similar to those coming from pitched sounds, although they are not perceived to be pitched sounds. However, the peaks are typically wider and less sharp than the peaks of voiced speech. By measuring the width of the most prominent peak, these peaks can be distinguished from those representing voiced speech.

Figure 1:
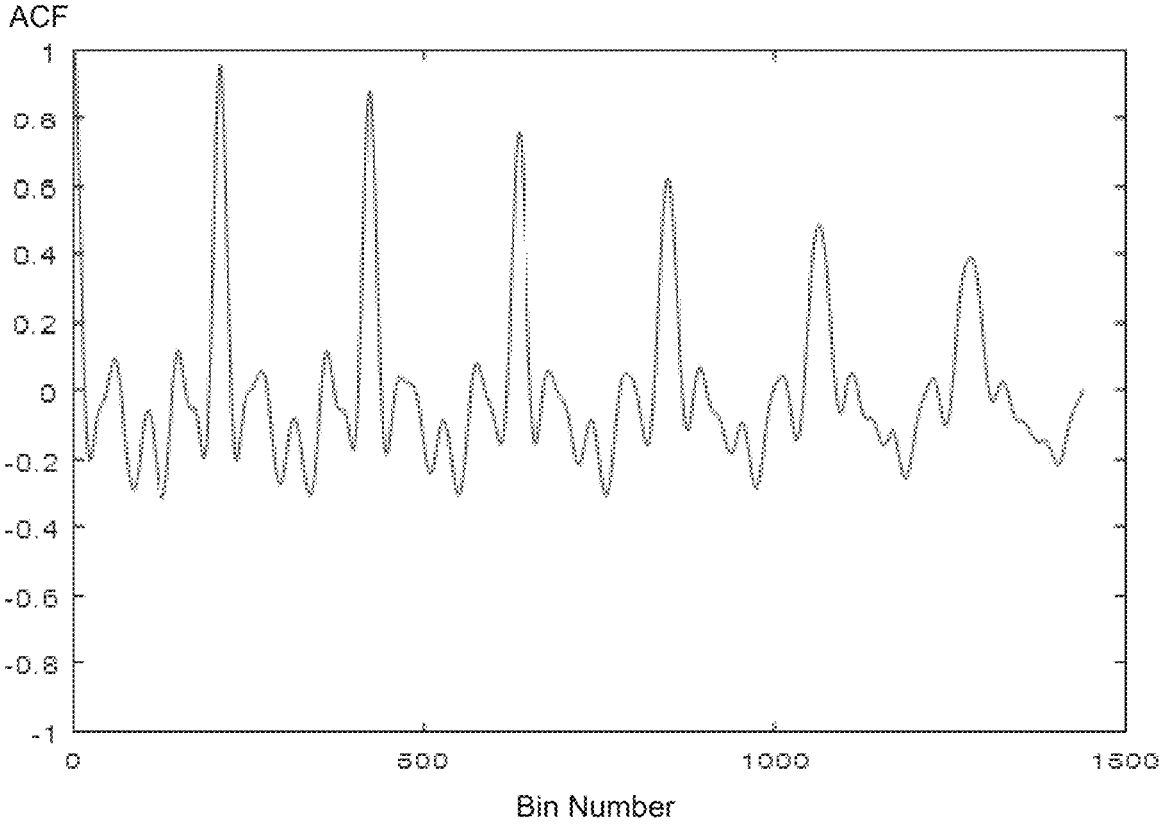
FIG. 1 illustrates a typical example of an ACF for a speech signal.
Figure 2A:
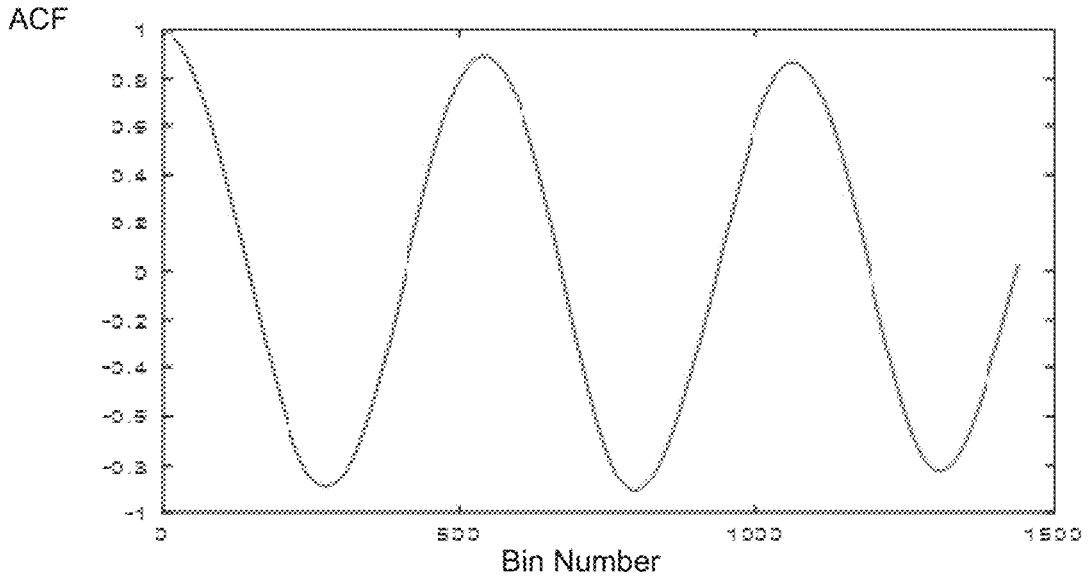
FIG. 2A shows an example of an ACF for a keyboard stroke.
Figure 2B:
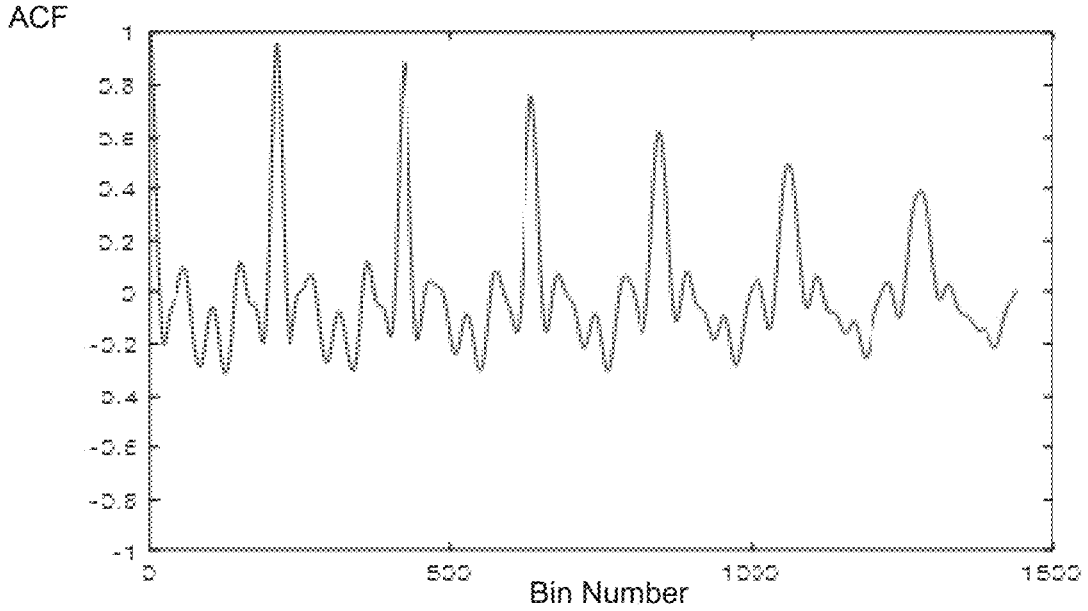
FIG. 2B shows an example of an ACF for a voiced part of a male voice.

FIG. 2A shows an example of an ACF for a keyboard stroke and FIG. 2B shows an example of an ACF for a voiced part of a male voice. As can be seen from FIG. 2A, the ACF may show high peaks even for sounds that are not perceived as pitched.

Figure 3:
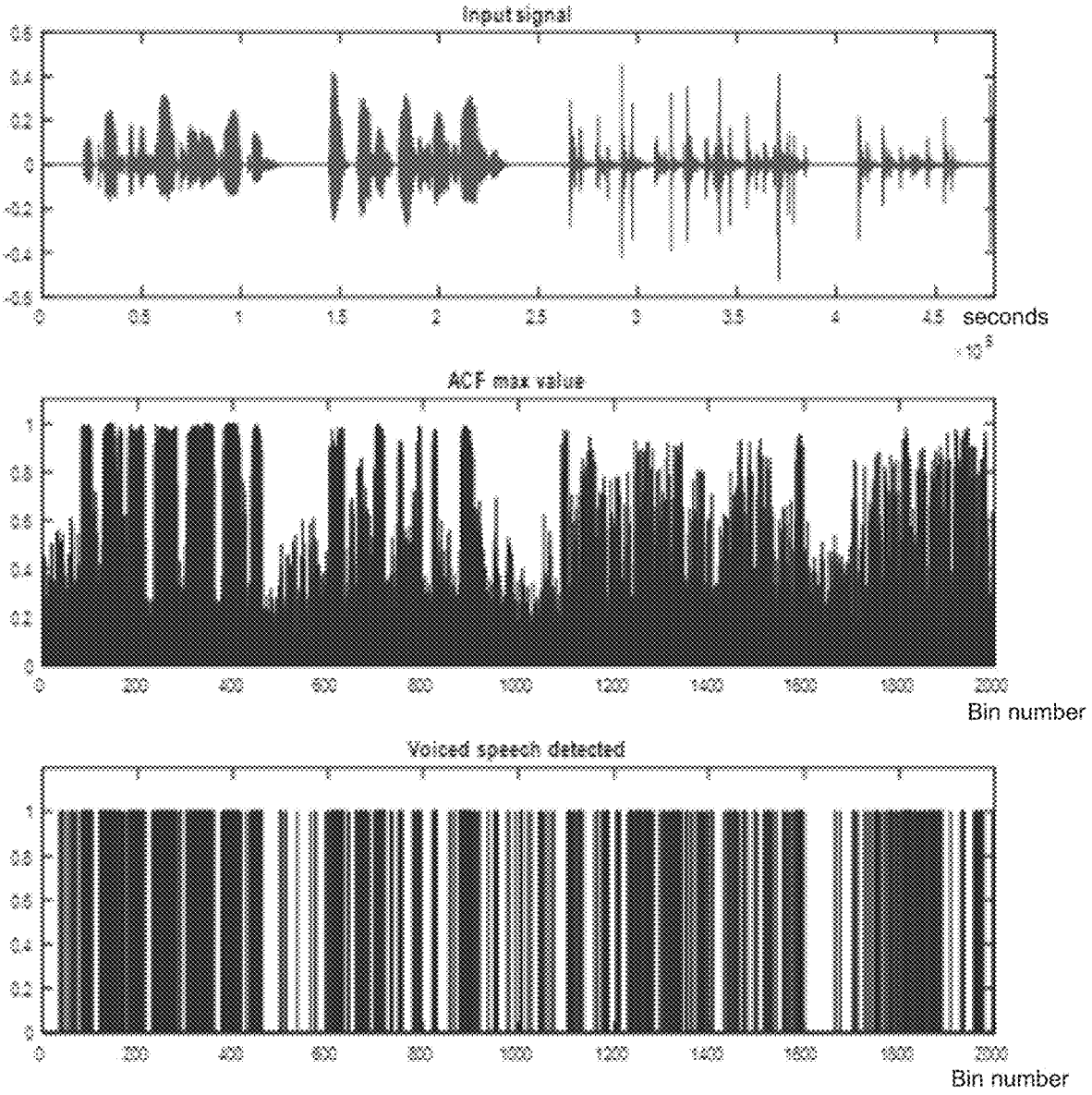
FIG. 3 shows an example of voiced speech detection based on peak height.

FIG. 3 shows an example of voiced speech detection based on peak height. An input audio signal of 5 seconds is used in this example. The first half of the signal contains two talk spurts, one female and one male, and the second half of the signal contains keyboard typing. The first graph shows the sample data of the input signal. The second graph shows the normalized ACF peak height for every frame, i.e. the height of the highest peak in the frame; each frame containing 5 ms or 240 samples of the input signal at 48 kHz sample rate. Dashed line in the second graph shows the peak height threshold. When the peak height exceeds the threshold, the frame is decided to contain voiced speech. The third graph shows the detection decision. That is, the value one in the third graph indicates that the frame contains voiced speech, while the value 0 indicates that the frame does not contain voiced speech. It is seen from the second graph that the max value of the ACF has high peaks for both speech and keyboard typing. Thus, there is a lot of false triggering on the sounds of the keyboard typing, which is seen on the third graph.

Therefore, a detection method that is based on the peak height only is not robust enough for reliable detection of voiced speech.

Figure 4:
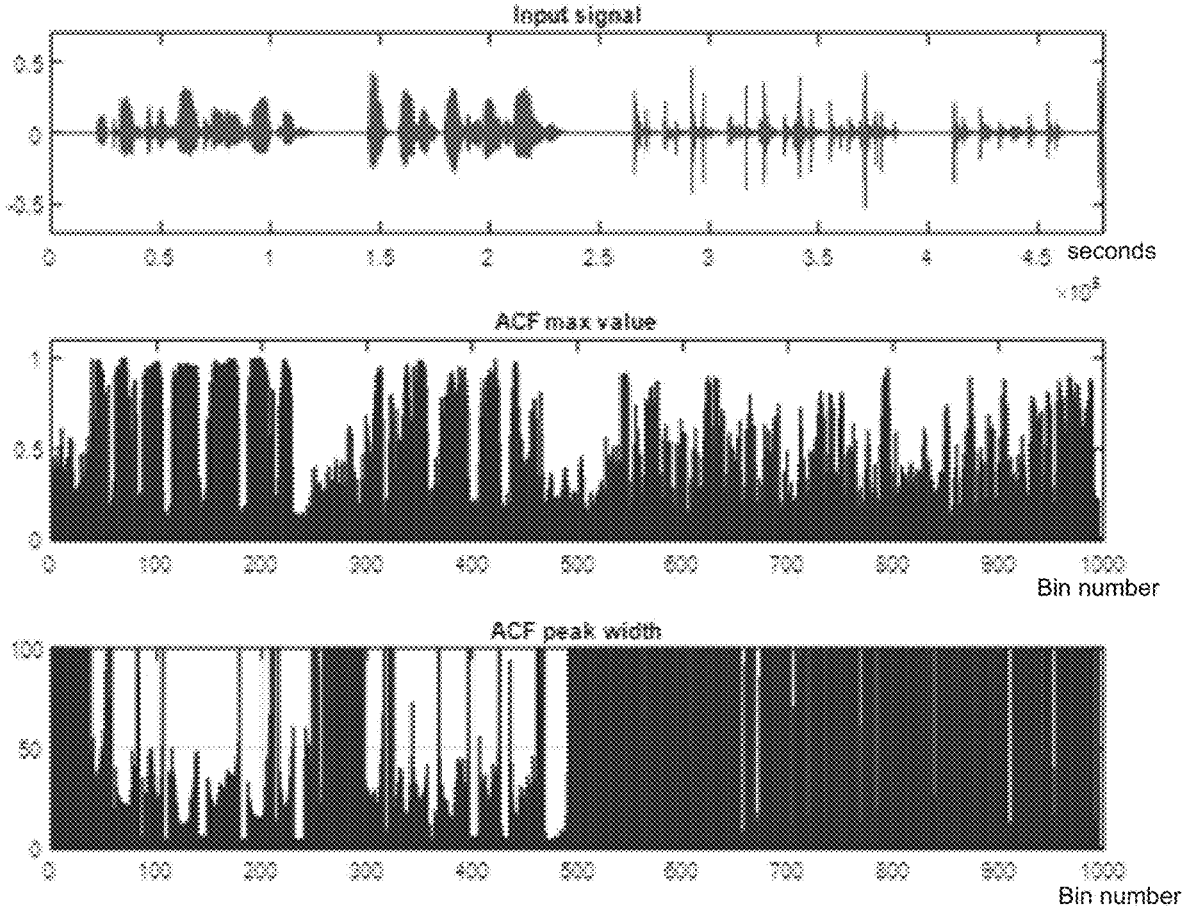
FIG. 4 shows an example of ACF peak widths.

In a voiced speech signal, the ACF peaks can be expected to be narrow and sharp, and it is therefore beneficial to measure also the width of the most prominent peak. FIG. 4 shows an example where the same input signal is used as in the example of FIG. 3. The first graph shows the sample data of the input signal. The second graph shows the normalized ACF peak height for every frame. The third graph shows the peak width of the highest peak for every frame. The y-axis represents number of bins of the ACF. It is seen from the third graph that peak width is lower during talk spurts than during keyboard typing.

By evaluating both the height and width of peaks in the ACF, a voiced speech detector can avoid false triggering on sounds that are not voiced speech but still produce high peaks in the ACF.

The present embodiments introduce a voiced speech detection method 500, where an ACF of a portion of an input signal is first calculated. Then a highest peak within a determined range of the calculated ACF is detected, and a peak width and a peak height of the detected peak are determined. Based on the peak width and the peak height it is decided whether a segment of an input audio signal comprises voiced speech.

Figure 5:
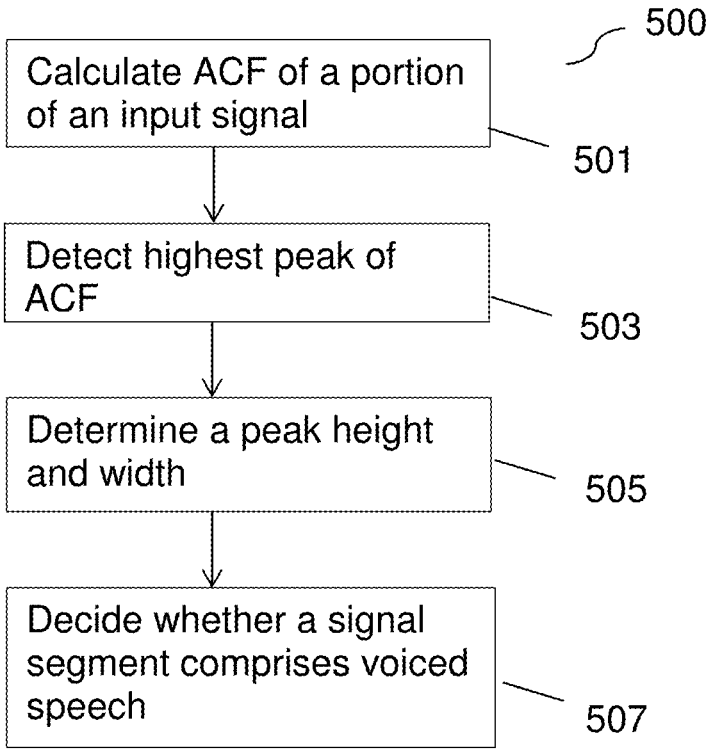
FIG. 5 is a flow chart of a method for voiced speech detection.

FIG. 5 illustrates the method 500. In a first step 501 an ACF of a portion of an input signal is calculated. The voice activity detection is often run on streaming audio by processing frames of a certain length, coming from e.g. a speech codec. The calculation of the ACF is, however, not dependent on receiving a fixed number of samples with every frame and therefore the method can be used in cases where the frame length is varying or the processing is done for each and every sample. The length of the analysis window over which the ACF is computed may be dynamic being based on, e.g., a previous or predicted pitch period. Thus, calculation of the ACF in the presented method is not limited to any specific length of a portion of an input signal to be processed at time.

The analysis window length, N, should be at least as long as the wavelength of the lowest frequency that should be detectable. In case of voiced speech, the length should correspond to at least one pitch period. Therefore, a buffer of past samples that has the same length as the analysis window is required for ACF calculation. The buffer can be updated with new samples either received sample by sample or as frames (or segments) of samples. A long analysis window results in a more stable ACF but also a temporal smearing effect. A long analysis window also has a strong effect on the overall complexity of the method.

In a next step 503, a highest peak of the calculated ACF is detected within a determined range. The range of interest, i.e. the determined range, corresponds to a pitch range, i.e., the interval where the pitch of a voiced speech is expected to exist. The fundamental frequency of speech can vary from 40 Hz for low-pitched male voices to 600 Hz for children or high-pitched female voices, typical ranges being 85-155 Hz for male voices, 165-255 Hz for female voices and 250-300 Hz for children. The range of interest can thus be determined to be between 40 Hz and 600 Hz, e.g., 85-300 Hz but any other sub-range or the whole 40-600 Hz range can also be used depending on the application. By limiting the pitch range the complexity is reduced since the ACF does not have to be computed for all bins.

An example range of 100-400 Hz corresponds to a pitch period of 2.5-10 ms. With 48 kHz sampling frequency this range of interest comprises bins 125-500 of the ACF in FIG. 2B where the example range of interest is marked by dashed lines. It should be noted that contrary to pitch estimation methods, it is not necessary to find the correct peak, i.e. the peak corresponding to the fundamental frequency of the voiced speech. The peak corresponding to the second harmonic frequency can also be used in detection of voiced speech.

The highest peak is detected by finding a maximum value of the ACF within the determined range. It should be noted that since an ACF can have high negative values, as can be seen in FIG. 2A, the highest peak is determined by the largest positive value of the ACF.

When the highest peak within a range of interest has been detected, the height and width of the peak are determined in step 505. The peak height is the maximum value at the top of peak, i.e., the maximum value of the ACF that was search in step 503 to identify the highest peak. The peak width is measured at certain distance from its top.

Figure 6:
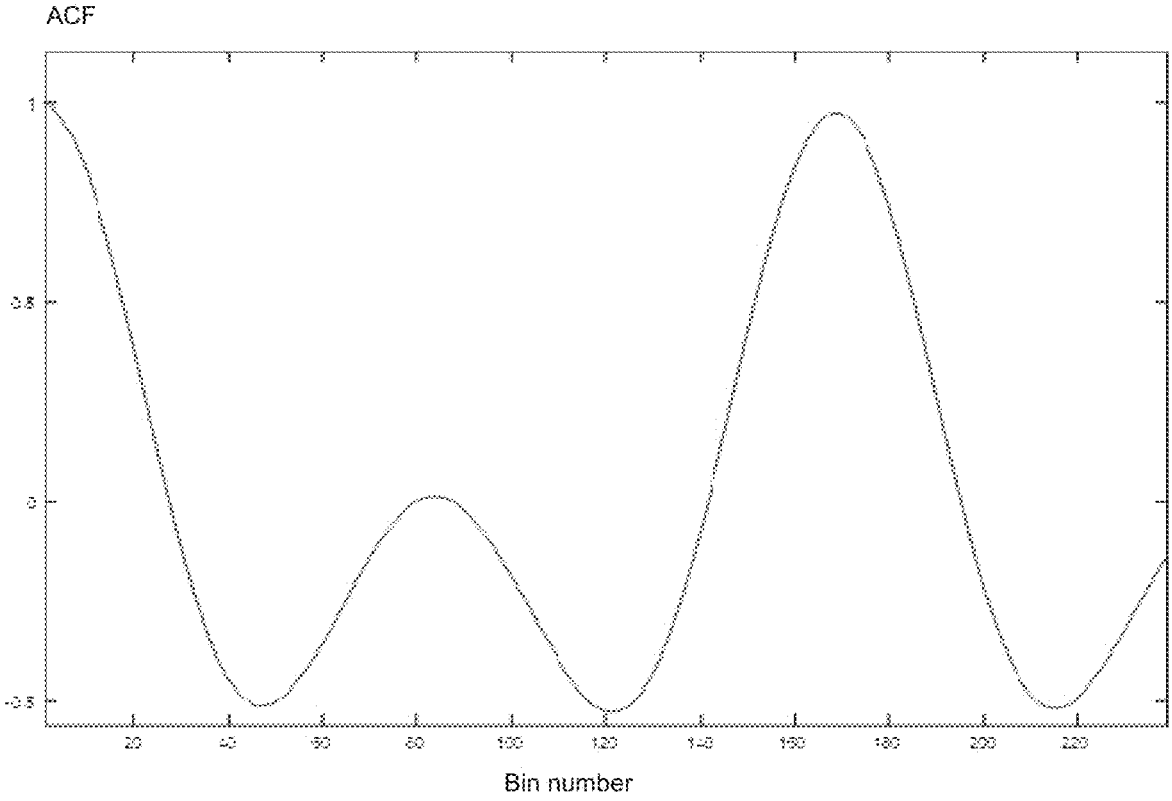
FIG. 6 shows an example of calculation of the ACF peak width.

FIG. 6 shows an example of determination of the ACF peak width in step 505. The peak width may be determined by calculating number of bins upwards from the middle of the peak before the AFC curve falls below a certain fall-off threshold. Correspondingly, the number of bins downwards from the middle of the peak before the AFC curve falls below said certain fall-off threshold is calculated. These numbers are then added to indicate the peak width. The fall-off threshold can be defined either as a percentage of the peak height or as an absolute value. With normalized ACF, i.e. values being in the range −1 . . . 1, a fall-off threshold value of 0.2 has been found to give good experimental results but the method is not limited by said value.

In step 507 it is decided based on the height and the width of the highest peak whether an input audio segment comprises voiced speech. This decision step is further explained in connection to FIG. 7.

The height of the detected highest peak of the ACF is compared to a first threshold $thr_1$ 701. If the peak height does not exceed the first threshold, the signal segment is decided not to comprise voiced speech. If the peak height exceeds the first threshold, the next comparison 703 is executed. In 703 the width of the highest peak is compared to a second threshold $thr_2$. If the peak width exceeds the second threshold, the peak is wider than expected for voiced speech and thus it is believed to contain no strong pitch. In this case the signal segment is decided not to comprise voiced speech. If the peak width is less than the second threshold, the peak is narrow enough to indicate voiced speech and the signal may contain pitch. In this case the signal is decided to comprise voiced speech.

As explained above, the segment of an input audio signal is decided to comprise voiced speech if the peak height exceeds a first threshold and the peak width is less than a second threshold. The segment of an input audio signal is decided not to comprise voiced speech if the peak height exceeds a first threshold and the peak width exceeds a second threshold. In one embodiment the second threshold is set to a constant value. In another embodiment the second threshold is dynamically set depending on a previously detected pitch. In still another embodiment the second threshold is dynamically set depending on pitch of the detected highest peak.

Figure 8:
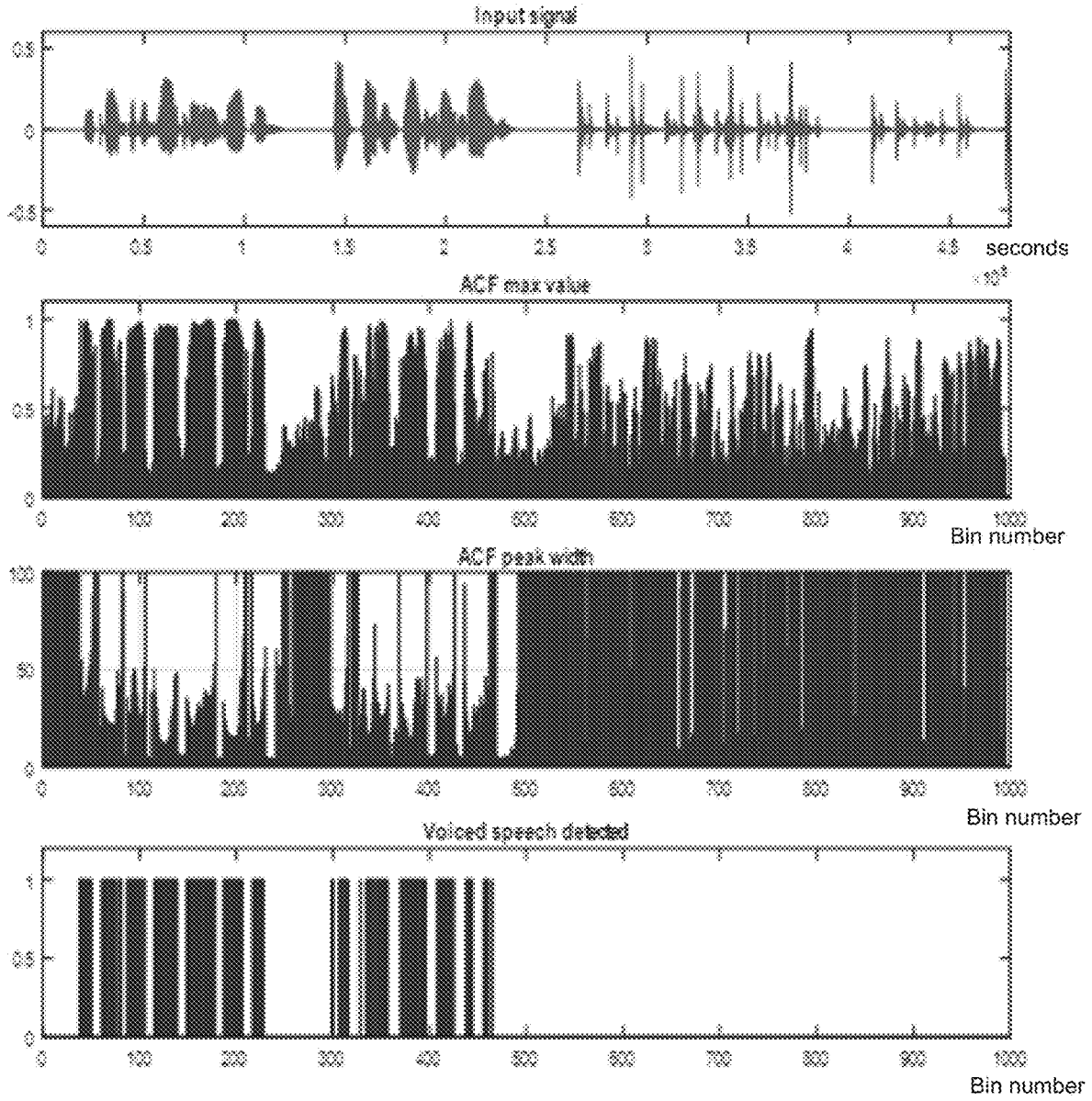
FIG. 8 shows an example of voiced speech detection based on both the peak height and the peak width.

FIG. 8 shows an example of voiced speech detection based on both the peak height and the peak width. The input audio signal is the same as in examples of FIGS. 3 and 4. The first graph shows the sample data of the input signal. The second graph shows the normalized ACF peak height for every frame. The third graph shows the peak width of the highest peak for every frame. Dashed lines in the second and third graph show a peak height threshold, $thr_1$, and a peak width threshold, $thr_2$, respectively. The fourth graph shows the detection decision. It is seen from the second graph that the max value of the ACF has high peaks for both speech and keyboard typing, whereas the peak width is lower during talk spurts as can be seen from the third graph. As can be seen from the fourth graph, signal segments containing typewriting are not detected as voiced speech. That is, the number of false detections is much lower than in the example of FIG. 3. In this case the peak width gives more useful information than the peak height.

The thresholds for the peak height, $thr_1$, and the peak width, $thr_2$, might be either constant or dynamic. In one embodiment, the thresholds could be dynamically adjusted depending on whether pitch was detected for the previous frame(s) or segment. For example, the threshold may be loosen, e.g., by lowering $thr_1$ and raising $thr_2$, if the previous frame(s) was decided to comprise voiced speech. The reason being that if the pitch was found in the previous frame it is likely that there is pitch also in the current frame. By using dynamic pitch dependent thresholds the detector can better follow a pitch trace even though it is partly corrupted by other non-pitched sounds. In one embodiment, the peak width threshold, $thr_2$, may be made dependent on the corresponding pitch of the evaluated peak (the highest peak in the current ACF). That is, the threshold $thr_2$ may be adapted to a pitch frequency. The lower the frequency of detected pitch, the wider are peaks in the ACF. In another embodiment, the width threshold may be set to be less than 50% of a pitch period of either the previous or the current frame.

Exact values of the thresholds may vary with different applications but experimentation has shown that a peak height threshold, $thr_1$, of 0.6 and peak width threshold, $thr_2$, of 1.6 ms (or 77 bins in the ACF with 48 kHz sampling frequency) work well in many cases. The present method is, however, not limited by these values.

Parameters from other algorithms may also impact the choice of thresholds on-the-fly. Apart from the thresholds, also the analysis window length may be changed dynamically. The reason could be for example to zoom in on the start and end of a talk spurt.

Figure 9A:
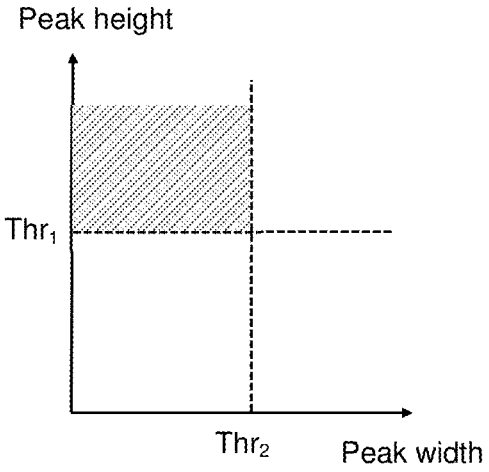
FIG. 9A illustrates an example of a decision function in a two dimensional space.
Figure 9B:
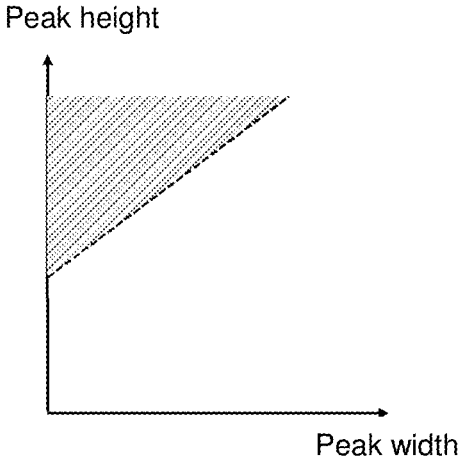
FIG. 9B illustrates another example of a decision function in a two dimensional space.

More elaborate evaluation of the peak height and width can be used instead of two thresholds. Peak height and width can be evaluated together in a two dimensional space, where a certain area is considered to indicate voiced speech. FIGS. 9A and 9B illustrates examples of a decision function in a two dimensional space. FIG. 9A shows the use of the two thresholds, thr1 and thr2, as described above. FIG. 9B shows how the decision can be based on a function of both the peak height and peak width.

The decision whether a signal segment comprises voiced speech, i.e., the output of block 507, may be simply a binary decision, 1 meaning that the signal segment comprises voiced speech and 0 meaning that the signal segment does not comprise voiced speech, or vice versa. However, the voiced speech detection does not necessarily need to indicate the presence of voiced speech as a binary decision. Sometimes a soft decision can be of interest, such as a value between 0.0 and 1.0 where 0.0 indicates that there is no voiced speech present at all and 1.0 indicates that voiced speech is the dominating sound. Values in-between would mean that there is some voiced speech present layered with other sounds.

The output signal segment for which the decision is made may correspond to the portion of an input signal for which the ACF is calculated in step 501. For example, the input signal portion may be a speech frame (fixed or dynamic length) and the decision is made in 507 whether said frame comprises voiced speech. However, the input signal may be analyzed in shorter segments than a frame. For example, a speech frame may be divided in two or more segments for analysis. Then the output signal segment for which the decision is made may correspond to segment that is part of the frame, i.e. there are more than one decision value for one frame. The decision whether the frame comprises voiced speech may also be a combined decision from decisions for separately analyzed segments. In this case, the decision may be a soft decision with a value between 0.0 and 1.0, or the frame may be decided to comprise voiced speech if majority of segments in the frame comprise voiced speech. Different segments may also be weighted differently, based e.g. their position in the frame, when combining decision values.

It should be noted that the analysis frame length, i.e. the length of the portion of an input signal for which the ACF is calculated, may in some embodiments be longer than an input frame. That is, there is no strong coupling of the length of the input frames and the length of the segment (the portion of an input signal) that is classified.

Even though the method is most efficient in detecting voiced speech, it will detect also other tonal sounds, e.g. musical instruments, as long as their fundamental frequency is within the predefined pitch range. With low-pitched tones, below 50 Hz, the peak width of e.g. a sine wave will get close to the threshold and therefore not detected. But sounds with such a low fundamental frequency are more perceived as rumble than tones. The result of music signals as an input will vary a lot on the character of the material. For very sparse arrangements with mostly a solo singer or instrument the method will detect pitch whereas more complex arrangements with more than one strong pitch (chords) or other non-tonal instruments will be regarded as background noise.

It should also be noted that the method is intended for detecting voiced speech and to distinguish voiced speech from other sounds that generate high peaks to the ACF, such as type writing, hand clapping, music with several instruments, etc. that can be classified as background noise. That is, the method as such is not sufficient for a VAD that requires also unvoiced speech sound detection.

The presented method is applicable and advantageous in many speech processing applications. It may be used in applications that are streaming an audio signal but as well for off-line processing of an audio signal, e.g. reading and processing stored audio signal from a file.

In speech coding applications it can be used to complement a conventional VAD to make voiced speech detection more robust. Many speech codecs benefit from efficient voice activity detection as only active speech needs to be coded and transmitted. With the present method for example type writing or hand clapping is not erroneously classified as voiced speech, and coded and transmitted as active speech. As background noise and other non-speech sounds does not need to be transmitted or can be transmitted with lower frame rate, there are savings in transmission bandwidth and also in power consumption of a user equipment, e.g., mobile phones.

Like in speech codecs, in speech recognition applications avoiding false classification of non-speech sounds as voiced speech is beneficial. The present method makes discarding of non-interesting parts of the signal, i.e. segments that does not contain speech, more efficient. The recognition algorithm does not need to waste resources by trying to recognize voiced sounds from sound segments that should be classified as background noise.

Many existing videoconference applications are designed to focus on the active speaker, for example by showing the video only from the active speaker or showing the active speaker at a larger window than other participants. The selection of the active speaker is based inter alia on VAD. Considering a situation when no-one is speaking but one participant is typing keyboard, it is likely that conventional methods interpret type writing as active speech and thus zooms on the type writing participant. The present method can be used to avoid this kind of false decisions in videoconferencing.

In an automatic level control (ALC/AGC) it is important to measure only speech level instead of measuring also background noise level. The present method can thus enhance ALC/AGC.

Figure 7:
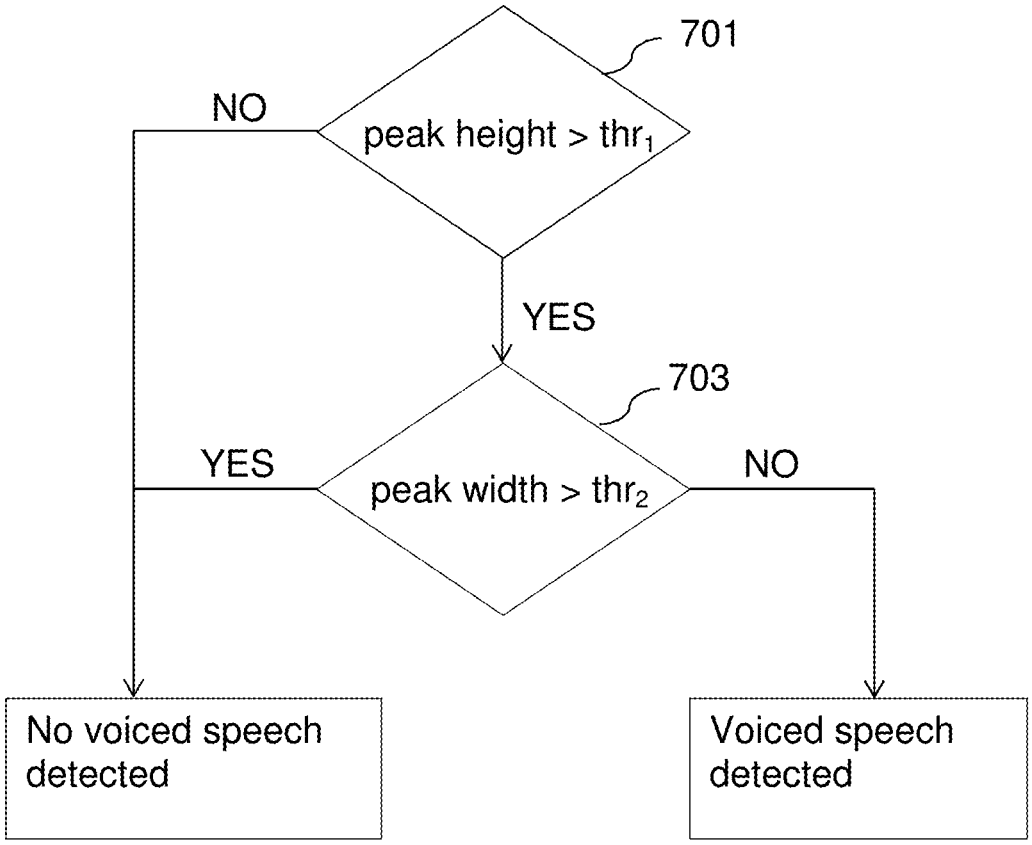
FIG. 7 is a flow chart of a decision method.
Figure 10:
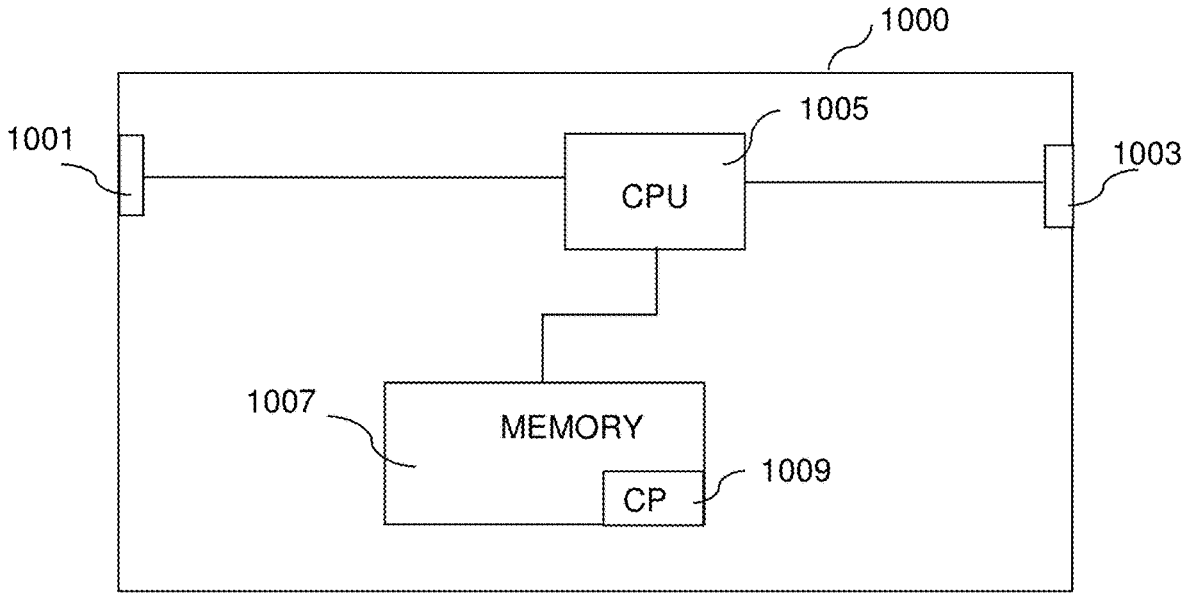
FIG. 10 shows an example of an apparatus according to an embodiment of the invention.

FIG. 10 shows an example of an apparatus 1000 performing the method 500 illustrated in FIGS. 5 and 7. The apparatus comprises an input 1001 for receiving a portion of an audio signal, and an output 1003 for outputting the decision whether an input audio signal segment comprises voiced speech. The apparatus 1000 further comprises a processor 1005, e.g. a central processing unit (CPU), and a computer program product 1007 in the form of a memory for storing the instructions, e.g. computer program 1009 that, when retrieved from the memory and executed by the processor 1005 causes the apparatus 1000 to perform processes connected with embodiments of the present voiced speech detection. The memory 1007 may further comprise a buffer of past input signal samples or the apparatus 1000 may comprise another memory (not shown) for storing past samples. The processor 1005 is communicatively coupled to the input node 1001, to the output node 1003 and to the memory 1007.

In an embodiment, the memory 1007 stores instructions 1009 that, when executed by the processor 1005, cause the apparatus 1000 to calculate an autocorrelation function, ACF, of a portion of an input audio signal, detect a highest peak of said autocorrelation function within a determined range, and to determine a peak width and a peak height of said peak. The apparatus 1000 is further caused to decide based on the peak width and the peak height whether a segment of an input audio signal comprises voiced speech. The deciding comprises deciding that the segment of an input audio signal comprises voiced speech if the peak height exceeds a first threshold and the peak width is less than a second threshold, or deciding that the segment of an input audio signal does not comprise voiced speech if the peak height exceeds a first threshold and the peak width exceeds a second threshold. The determination of the peak width comprises calculating number of bins upwards from the middle of the peak before the ACF curve falls below a fall-off threshold, calculating number of bins downwards from the middle of the peak before the ACF curve falls below said fall-off threshold, and adding the numbers of calculated bins to indicate the peak width.

By way of example, the software or computer program 1009 may be realized as a computer program product, which is normally carried or stored on a computer-readable medium, preferably non-volatile computer-readable storage medium. The computer-readable medium may include one or more removable or non-removable memory devices including, but not limited to a Read-Only Memory (ROM), a Random Access Memory (RAM), a Compact Disc (CD), a Digital Versatile Disc (DVD), a Blue-ray disc, a Universal Serial Bus (USB) memory, a Hard Disk Drive (HDD) storage device, a flash memory, a magnetic tape, or any other conventional memory device.

The apparatus 1000 may be comprised in or associated with a server, a client, a network node, a cloud entity or a user equipment such as a mobile equipment, a smartphone, a laptop computer, and a tablet computer. The apparatus 1000 may be comprised in a speech codec, in a video conferencing system, in a speech recognizer, in a unit embedded in or attachable to a vehicle, such as a car, truck, bus, boat, train, and airplane. The apparatus 1000 may be comprised in or be a part of a voice activity detector.

Figure 11:
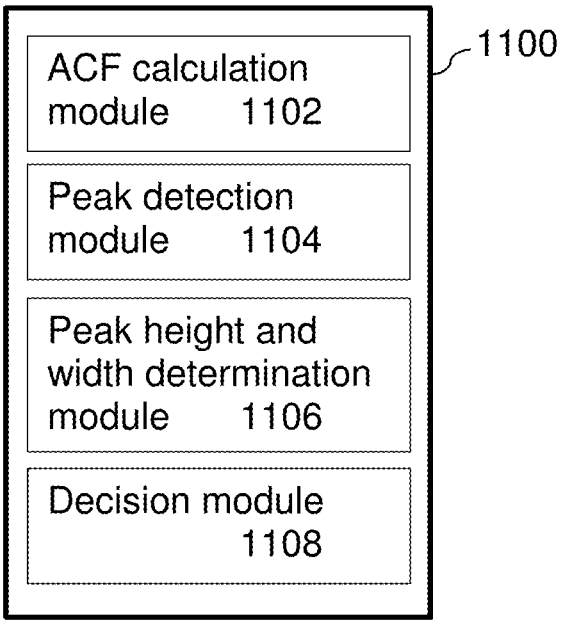
FIG. 11 shows another example of an apparatus according to an embodiment of the invention.

FIG. 11 is a functional block diagram of a detector 1100 that is configured to detect voiced speech in an audio signal. The detector 1100 comprises an ACF calculation module 1102 that is configured to calculate an ACF of a portion of an input audio signal. The detector 1100 further comprises a peak detection module 1104, that is configured to detect a highest peak of the ACF within a determined range, and a peak height and width determination module 1106 that is configured to determine a peak width and a peak height of the detected highest peak. The detector 1100 further comprises a decision module 1108 that is configured to decide based on the peak width and the peak height whether a segment of an input audio signal comprises voiced speech.

It is to be noted that all modules 1102 to 1108 may be implemented as a one unit within an apparatus or as separate units or some of them may be combined to form one unit while some of them are implemented as separate units. In particular, all above described units might be comprised in one chipset or alternatively some or all of them might be comprised in different chipsets. In some implementations the above described modules might be implemented as a computer program product, e.g. in the form of a memory or as one or more computer programs executable from the memory of an apparatus.

Embodiments of the present invention may be implemented in software, hardware, application logic or a combination of software, hardware and application logic. The software, application logic and/or hardware may reside on a memory, a microprocessor or a central processing unit. If desired, part of the software, application logic and/or hardware may reside on a host device or on a memory, a microprocessor or a central processing unit of the host. In an example embodiment, the application logic, software or an instruction set is maintained on any one of various conventional computer-readable media.

Without in any way limiting the scope, interpretation, or application of the claims appearing below, a technical effect of one or more of the example embodiments disclosed herein is that voiced speech segments can be efficiently detected in an audio signal. Further technical effect is that by evaluating both the height and width of peaks in the ACF, the voiced speech detector can avoid false triggering on sounds that are not voiced speech but still produce high peaks in the AFC.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above described example embodiments of the invention, these descriptions should not be viewed in a limiting sense. Rather, there are several variations and modifications which may be made without departing from the scope of the present invention as defined in the appended claims.

The invention claimed is:

1. A method for audio signal processing, the method comprising:

calculating a correlation function of a portion of an input audio signal;

detecting a highest peak of said correlation function;

determining a peak width of said highest peak;

determining a peak height of said highest peak;

comparing the determined peak height with a height threshold;

comparing the determined peak width with a width threshold; and deciding based on the peak width and the peak height whether a segment of the input audio signal comprises voiced speech.

2. The method of claim 1, wherein the segment of an input audio signal is decided to comprise voiced speech as a result of determining that the peak height exceeds the height threshold and the peak width is less than the width threshold.

3. The method of claim 1, wherein the segment of the input audio signal is decided not to comprise voiced speech as a result of determining that the peak height exceeds the height threshold and the peak width exceeds the width threshold.

4. The method of claim 3, wherein the width threshold is set to a constant value.

5. The method of claim 3, wherein the width threshold is dynamically set depending on a previously detected pitch.

6. The method of claim 3, wherein the width threshold is dynamically set depending on pitch of said detected highest peak.

7. The method of claim 1, wherein the peak width is determined by:

calculating number of bins upwards from the middle of the peak before the correlation curve falls below a fall-off threshold;

calculating number of bins downwards from the middle of the peak before the correlation curve falls below said fall-off threshold; and adding the numbers of calculated bins to indicate the peak width.

8. The method of claim 1, wherein the method further comprises, based on the comparison of the determined peak height with the height threshold, determining that the determined peak height exceeds the height threshold, and the height threshold is less than 1.

9. The method of claim 1, wherein detecting the highest peak of said correlation function comprises detecting the highest peak within a pitch range.

10. A computer program product comprising a non-transitory computer readable medium storing a computer program comprising computer readable code units which when run on an apparatus causes the apparatus to perform the method of claim 1.

11. An apparatus comprising:

a processor, and a memory storing instructions that, when executed by the processor, cause the apparatus to:

calculate a correlation function of a portion of an input audio signal;

detect a highest peak of said correlation function;

determine a peak width of said highest peak;

determine a peak height of said highest peak;

compare the determined peak height with a height threshold;

compare the determined peak width with a width threshold; and decide based on the peak width and the peak height whether a segment of the input audio signal comprises voiced speech.

12. The apparatus of claim 11, wherein the apparatus is configured to decide that the segment of the input audio signal comprises voiced speech as a result of determining that the peak height exceeds a height threshold and the peak width is less than a width threshold.

13. The apparatus of claim 11, wherein the apparatus is configured to decide that the segment of the input audio signal does not comprise voiced speech as a result of determining that the peak height exceeds a height threshold and the peak width exceeds a width threshold.

14. The apparatus of claim 11, wherein the apparatus is configured to determine the peak width by performing a process that includes:

calculating number of bins upwards from the middle of the peak before the ACF curve falls below a fall-off threshold;

calculating number of bins downwards from the middle of the peak before the ACF curve falls below said fall-off threshold; and adding the numbers of calculated bins to indicate the peak width.

15. The apparatus of claim 11, wherein the apparatus is comprised in: a server, a client, a network node, a cloud entity or a user equipment.

16. The apparatus of claim 11, wherein the apparatus is comprised in a voice activity detector.

17. An apparatus for audio signal processing, the detector apparatus comprising:

a memory; and a processor coupled to the memory and being configured to:

calculate a correlation function of a portion of an input audio signal;

detect a highest peak of said correlation function;

determine a peak width of said highest peak;

determine a peak height of said highest peak;

compare the determined peak height with a height threshold;

compare the determined peak width with a width threshold; and decide based on the peak width and the peak height whether a segment of the input audio signal comprises voiced speech.

18. The apparatus of claim 17, wherein the detector apparatus is configured to decide that the segment of the input audio signal comprises voiced speech as a result of determining that the peak height exceeds a height threshold and the peak width is less than a width threshold.

19. The apparatus of claim 17, wherein the detector apparatus is configured to decide that the segment of the input audio signal does not comprise voiced speech as a result of determining that the peak height exceeds a height threshold and the peak width exceeds a width threshold.

20. The apparatus of claim 17, wherein the detector apparatus is configured to determine the peak width by performing a process that includes:

calculating number of bins upwards from the middle of the peak before the ACF curve falls below a fall-off threshold;

calculating number of bins downwards from the middle of the peak before the ACF curve falls below said fall-off threshold; and adding the numbers of calculated bins to indicate the peak width.

* * * * *